US011468748B1

(12) United States Patent
Wang et al.

(10) Patent No.: US 11,468,748 B1
(45) Date of Patent: Oct. 11, 2022

(54) STAND INCLUDING DYNAMIC COUNTERWEIGHT FOR AUTO-BALANCING OF AN ELECTRONIC POINT-OF-SALE TERMINAL DISPLAY

(71) Applicant: Toshiba Global Commerce Solutions Holdings Corporation, Tokyo (JP)

(72) Inventors: Merrick C. Wang, Taipei (TW); Kenter Su, Taipei (TW); Rebecca Hsiao, Taipei (TW); Wayne Liu, Taipei (TW)

(73) Assignee: Toshiba Global Commerce Solutions Holdings Corporation, Tokyo (JP)

( * ) Notice: Subject to any disclaimer, the term of this patent is extended or adjusted under 35 U.S.C. 154(b) by 0 days.

(21) Appl. No.: 17/373,470

(22) Filed: Jul. 12, 2021

(51) Int. Cl.
*G07G 1/00* (2006.01)
*G07G 1/12* (2006.01)

(52) U.S. Cl.
CPC ..... *G07G 1/0018* (2013.01); *G07G 1/12* (2013.01)

(58) Field of Classification Search
CPC ..... G07G 1/0018; G07G 1/12
USPC ..... 235/383; 902/22, 30
See application file for complete search history.

(56) References Cited

U.S. PATENT DOCUMENTS 5,569,895 A * 10/1996 Lynch ..... F16M 11/10 361/679.61
7,152,836 B2 12/2006 Pfister
7,573,711 B2 8/2009 Kim
7,883,063 B2 2/2011 Mesfin
7,954,780 B2 6/2011 Dittmer
(Continued)

FOREIGN PATENT DOCUMENTS

CN 108230584 A * 6/2018
CN 108320406 A * 7/2018

OTHER PUBLICATIONS

How to Asia, Four-Bar Linkage (Crank Slider), https://www.youtube.com/watch?v=nL3dpBz5xKc, Published Aug. 4, 2017, 1 page.

*Primary Examiner* — Suezu Ellis
(74) *Attorney, Agent, or Firm* — Stanek Lemon Crouse & Meeks, P.A.

(57) ABSTRACT

A stand for an electronic point-of-sale terminal can include a moveable arm including a mounting plate at an upper end thereof and a moveable hinge at a lower end thereof, the moveable arm configured to move from a forward cantilevered position to a rearward cantilevered position over a check-out area associated with an electronic point-of-sale terminal, the mounting plate configured to moveably couple the moveable arm to an electronic display of the electronic point-of-sale terminal, the moveable hinge configured to rotate responsive to movement of the moveable arm, a base plate configured to maintain the electronic point-of-sale terminal in an upright position when the electronic display is moved between the forward cantilevered position and the rearward cantilevered position, and a moveable counterweight inside the base plate, and moveably coupled to the moveable hinge, to move from a first counterweight position inside the base plate when the moveable arm is in the forward cantilevered position to a second counterweight position inside the base plate when the moveable arm is in the rearward cantilevered position.

16 Claims, 4 Drawing Sheets

(56) References Cited

U.S. PATENT DOCUMENTS

2011/0303805 A1* 12/2011 Lau ..... H05K 5/0204
248/125.8
2016/0051067 A1* 2/2016 Law ..... F16M 11/28
361/679.22

* cited by examiner

STAND INCLUDING DYNAMIC COUNTERWEIGHT FOR AUTO-BALANCING OF AN ELECTRONIC POINT-OF-SALE TERMINAL DISPLAY

FIELD

The present invention relates to the field of electronic point-of-sale (POS) terminals.

BACKGROUND

It is known to support a flat panel monitor using a stand with a counterweight balance that is configured to accommodate a range of display sizes. The counterweight balance may allow a user to slide the monitor up and down on its stand to customize the viewing height. Stands for electronic displays are also discussed in, for example, U.S. Pat. Nos. 7,573,711, 7,883,063, 7,152,836, and 7,954,780.

SUMMARY

Embodiments according to the present invention can provide stands that include a dynamic counterweight for auto-balancing of an electronic point-of-sale terminal display. Pursuant to these embodiments, a stand for an electronic point-of-sale terminal can include a moveable arm including a mounting plate at an upper end thereof and a moveable hinge at a lower end thereof, the moveable arm configured to move from a forward cantilevered position to a rearward cantilevered position over a check-out area associated with an electronic point-of-sale terminal, the mounting plate configured to moveably couple the moveable arm to an electronic display of the electronic point-of-sale terminal, the moveable hinge configured to rotate responsive to movement of the moveable arm, a base plate configured to maintain the electronic point-of-sale terminal in an upright position when the electronic display is moved between the forward cantilevered position and the rearward cantilevered position, and a moveable counterweight inside the base plate, and moveably coupled to the moveable hinge, to move from a first counterweight position inside the base plate when the moveable arm is in the forward cantilevered position to a second counterweight position inside the base plate when the moveable arm is in the rearward cantilevered position.

DETAILED DESCRIPTION OF EMBODIMENTS ACCORDING TO THE INVENTION

Figure 1:
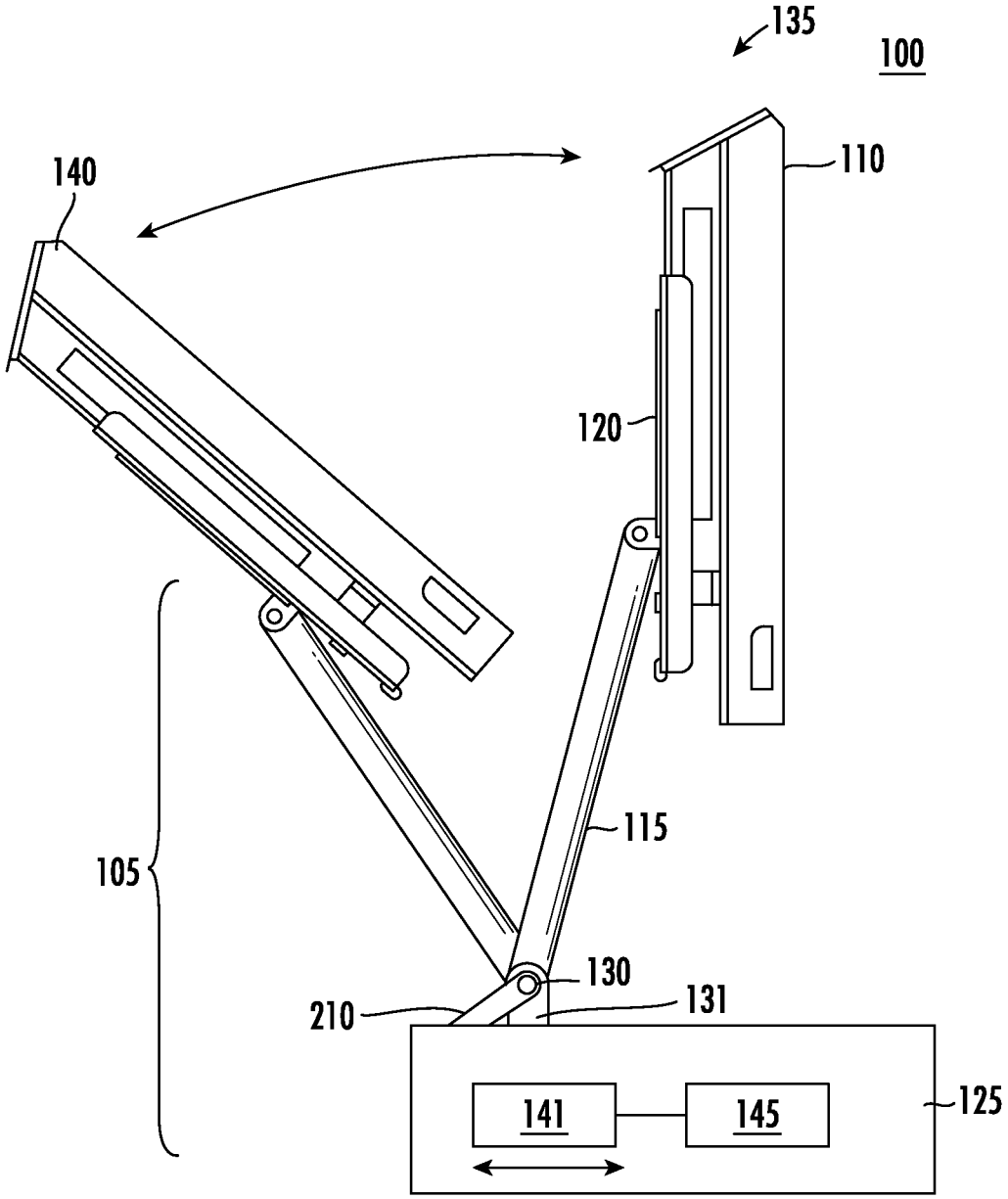
FIG. 1 is a schematic illustration of an electronic POS terminal including a stand that houses a moveable counterweight therein that is configured to dynamically move as an electronic display of the POS terminal is moved between a forward cantilevered position and a rearward cantilevered position, to maintain the POS terminal in a stable position on a surface in some embodiments according to the invention.

Exemplary embodiments of the present disclosure are described in detail with reference to the accompanying drawings. The disclosure may, however, be exemplified in many different forms and should not be construed as being limited to the specific exemplary embodiments set forth herein. Rather, these exemplary embodiments are provided so that this disclosure will be thorough and complete, and will fully convey the scope of the disclosure to those skilled in the art.

As appreciated by the present inventors, customers may manipulate the position of an electronic point of sale terminal so that they may more efficiently interact with the terminal during checkout. However, if the point-of-sale terminal is positioned, for example, too far forward (or behind) of the terminal stand in the horizontal direction, the terminal may become unstable and fall over. Typically, compliance standards require that the terminal remain stable even if the display is positioned 15 degrees from the completely upright position. However, many times customers would like the terminal to be position beyond this compliance standard.

In some environments according to the invention, a movable counterweight can be provided within a base plate of the terminal which moves (horizontally) automatically responsive to an actuator means that can counter-balance a weight of the display when in the forward or rearward cantilevered position. For example, in some environment environments according to the invention, the movable counterweight is moved opposite the direction in which the display is moved by the customer so that the center of mass of the terminal is moved in a direction that is opposite to the direction in which he display is moved. In some embodiments according to the invention, moving the counterweight can allow the terminal to remain stable on a surface despite the movement of the display beyond a point where the terminal would otherwise fall over, such as beyond 15 degrees of completely upright. In some embodiments, a stand that includes a moveable counterweight and an actuator means to automatically move the counterweight in the required direction can be retrofitted to existing terminals.

In some environments according to the invention, the actuator means can be provided by a mechanical structure, in electromechanical structure, a piezoelectric structure, or the like. In some environments according to the invention, the actuator means can be provided by a linkage bar assembly that is coupled between a moveable hinge of a moveable arm to which the electronic display is connected. When the electronic display is moved forward or rearward the linkage assembly moves the moveable counterweight in the opposite direction responsive to the movement of the moveable hinge. In some embodiments according to the invention, the linkage bar assembly includes one linkage bar that couples the moveable hinge to the moveable counterweight. In other embodiments according to the invention, the linkage bar assembly includes two or more linkage bars that couple the moveable hinge to the moveable counterweight. It will be understood that the linkage bar assembly can be modified to provide more or less movement to the moveable counterweight based on the available space in the terminal and/or the desired amount of movement provided to the moveable counterweight.

In some environments according to the invention, the actuator means can also include a processor circuit coupled to a sensor circuit that indicates a position of the display such that the processor can determine the position of the moveable counterweight such that the terminal can remain stable. In some environments according to the invention, the processor circuit can control an electric motor that drives the movable counterweight to the position determined by the processor circuit. In still further environments according to the invention, the processor circuit can control a linear actuator to drive the movable counterweight to the appropriate position. In still further environments according to the invention, the processor circuit can control a piezoelectric circuit to position the movable counterweight in the desired location.

FIG. 1 is a schematic illustration of an electronic POS terminal 100 including a stand 105 including a base plate 125 that houses a moveable counterweight 141 therein that is configured to dynamically move as an electronic display 110 of the POS terminal 100 is moved between a forward cantilevered position 135 and a rearward cantilevered position 140, to maintain the POS terminal 100 in a stable position on a surface 127 in some embodiments according to the invention.

According to FIG. 1, in some embodiments according to the present invention, the stand 105 includes a mounting plate 120 that is configured to mount to the electronic display 110. It will be understood that the electronic display 110 can be combined with other components such as system electronics to provide what is sometimes referred to as an "all-in-one" system that can provide operations of the terminal 100 such as those used by the customer, during checkout. Accordingly, in some embodiments according to the invention, the weight of the electronic display 110 can include the weight of the "all-in-one" system.

As further shown in FIG. 1, the stand 105 also includes a moveable arm 115 that is connected to the mounting plate 120 and includes a moveable hinge 130 that can be mounted in a mounting bracket 131 that is connected to the base plate 125. The moveable counterweight 141 is located inside the base plate 125 and is coupled to an actuator means 145. The actuator means 145 is configured to move the moveable counterweight 141 (forward or rearward inside the base plate 125) to automatically counter-balance the weight of the electronic display 110 when moved between the rearward cantilevered position 140 and the rearward cantilevered position 135, respectively.

Figure 2:
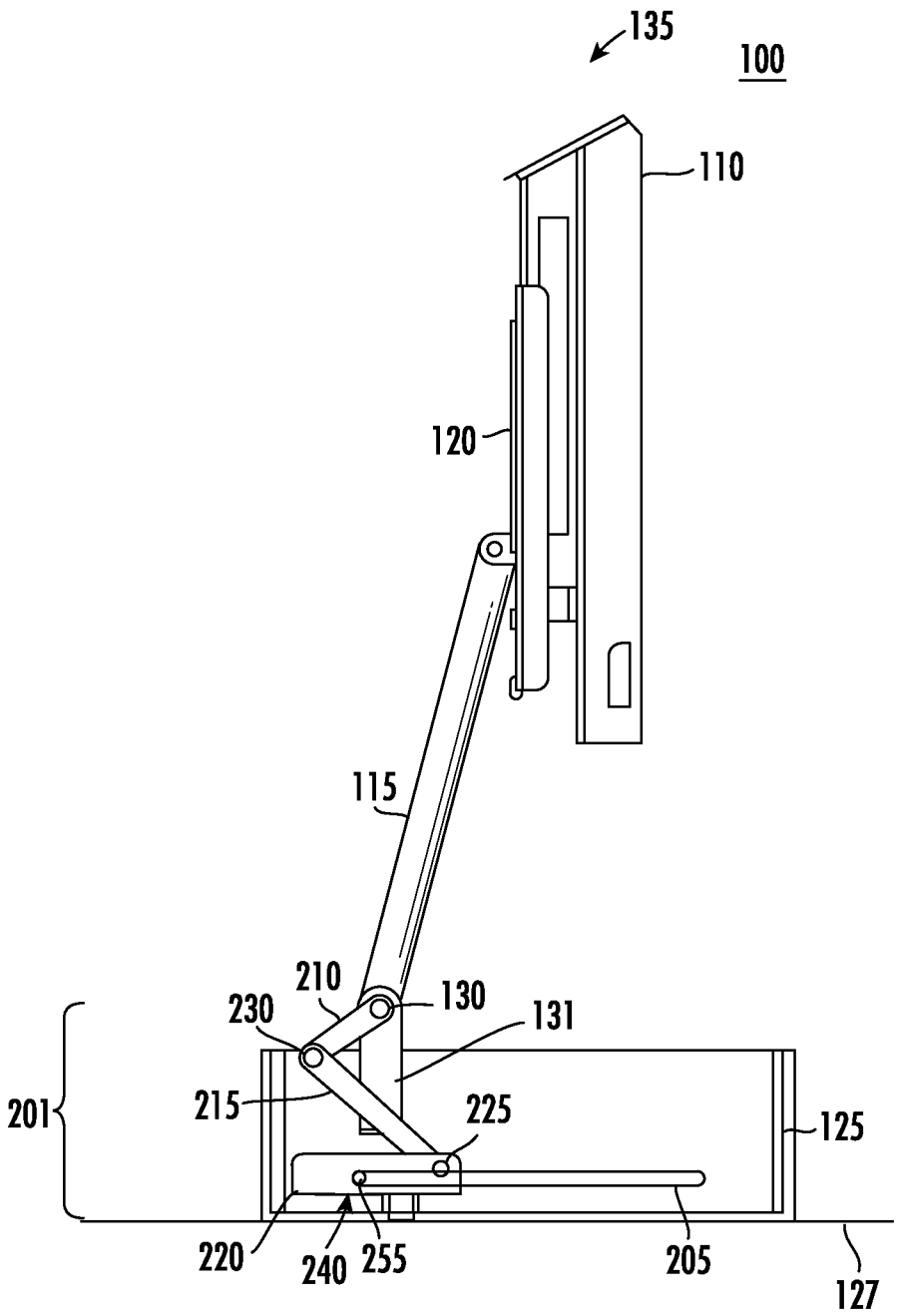
FIG. 2 is a schematic illustration of the display of the electronic POS terminal in the forward cantilevered position and the moveable counterweight coupled to a moveable arm of the stand via a linkage bar assembly hat is configured to move the moveable counterweight to a first position inside the base plate of the stand to counter-balance the weight of the electronic display in the forward cantilevered position in some embodiments according to the invention.

FIG. 2 is a schematic illustration of the display of the electronic POS terminal 100 in the forward cantilevered position 135 and a moveable counterweight 220 coupled to the moveable arm 115 of the stand 105 via a linkage bar assembly 201 that is configured to automatically move the moveable counterweight 220 to a first position 240 inside the base plate 125 of the stand 105 in response to movement of the moveable hinge 130 to counter-balance the weight of the electronic display 110 in the forward cantilevered position 135 in some embodiments according to the invention. According to FIG. 2, the linkage bar assembly 201 includes a first linkage bar 210 having an upper end that is coupled to the moveable hinge 130 and extends downward (through an opening in the upper surface of the base plate 125) to a lower end that is coupled to a hinge 230. The linkage bar assembly 201 further includes a second linkage bar 215 having an upper end that is coupled to the first linkage bar 210 via the hinge 230 and that extends downward (opposite the direction of the first linkage bar 21) to couple with the moveable counterweight 220 via a hinge 225.

When the electronic display 110 is moved toward the forward cantilevered position 135, the moveable arm 115 rotates the moveable hinge 130 clockwise to pull the movable counterweight 220 back toward the position 240 on a track 205 on which the movable counterweight 220 is secured by a pin 255, as shown. Moving the counterweigh backward (away from the direction of the forward cantilevered position 135) shifts the center of mass of the terminal 100 backward away from the direction of the forward cantilevered position 135 so that the terminal 100 may remain ore stable on the surface 127 than would otherwise be possible with conventional arrangements.

Figure 3:
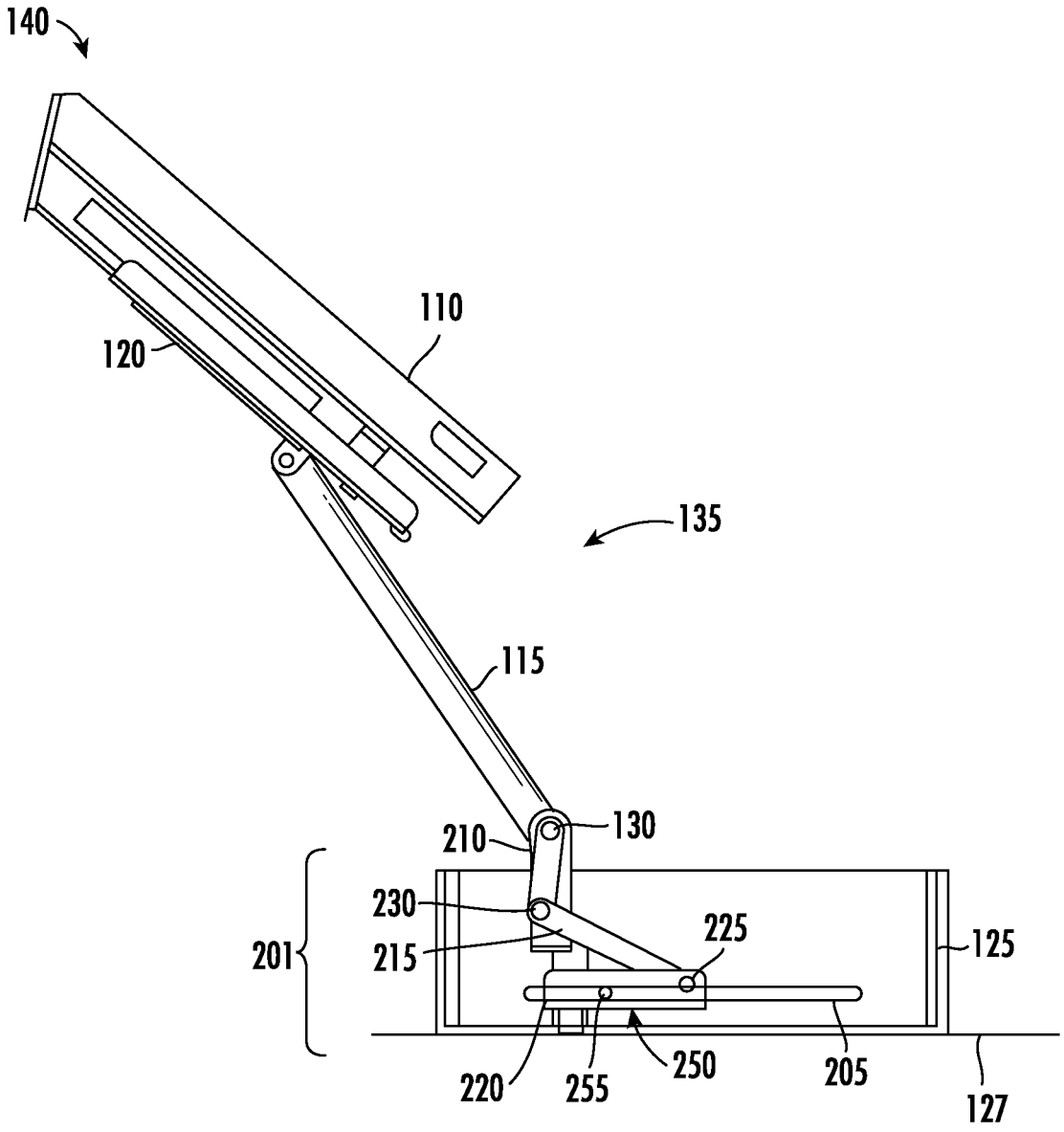
FIG. 3 is a schematic illustration of the display of the electronic POS terminal in the rearward cantilevered position and the moveable counterweight in a second position inside the base plate of the stand to counter-balance the weight of the electronic display in the rearward cantilevered position in some embodiments according to the invention.

FIG. 3 is a schematic illustration of the display of the electronic POS terminal 100 in the rearward cantilevered position 140 and the moveable counterweight 220 in a second position 250 inside the base plate 125 of the stand 105 to counter-balance the weight of the electronic display 110 in the rearward cantilevered position 140 in some embodiments according to the invention.

As shown in FIG. 3, when the electronic display 110 is moved toward the rearward cantilevered position 140, the moveable arm 115 rotates the moveable hinge 130 counter-clockwise to pull the movable counterweight 220 forward toward the second position 250 on a track 205 as shown. Moving the counterweigh 220 forward (away from the direction of the rearward cantilevered position 140) shifts the center of mass of the terminal 100 forward away from the direction of the rearward cantilevered position 140 so that the terminal 100 may remain more stable on the surface 127 than would otherwise be possible with conventional arrangements.

Figure 4:
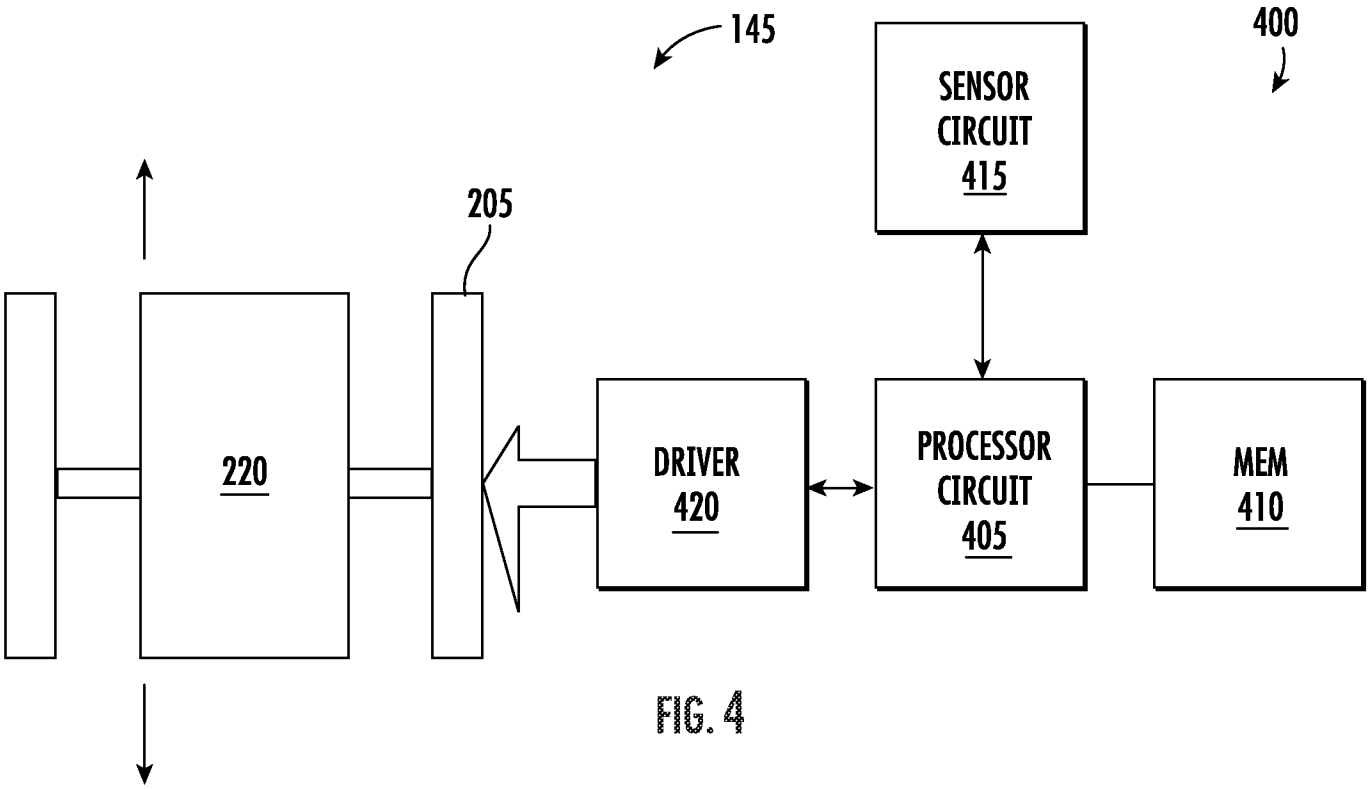
FIG. 4 is a block diagram of an actuator means configured to move the moveable counterweight between the first and second positions to counter-balance the weight of the electronic display in the forward and rearward cantilevered positions in some embodiments according to the invention.

FIG. 4 is a block diagram of the actuator means 145 configured to move the moveable counterweight 141 between the first and second positions to counter-balance the weight of the electronic display 110 in the forward and rearward cantilevered 135 and 140 positions in some embodiments according to the invention. According to FIG. 4, the actuator means 145 can include a driver 420 that is operatively coupled to the movable counterweight 220 and which is configured to move the movable counterweight 220 on the track 205 between the first and second position in response to movement of the display 110.

As further shown in FIG. 4, the actuator means 145 can also include a sensor circuit 415 that is can be used to determine the position of the electronic display 110. In some embodiments according to the invention, the sensor circuit 415 can be an electrical, optical, or mechanical device that can sense the position of the moveable arm 115, which can be used to determine the position of the electronic display 110. In some embodiments according to the invention, the sensor circuit 415 can indicate the position of the electronic display directly.

The sensor circuit 415 is operatively coupled to a processor circuit 405, which in cooperation with a memory 410, can determine the position of the electronic display 110 (using the output of the sensor circuit 415) and the distance that the moveable counterweigh 220 should be moved responsive to the movement of the electronic display 110. In operation, when the electronic display 110 is moved, the processor circuit 405 can sense the changing position of the electronic display 110 and determine the new position to which the moveable counterweight 220 is to be moved, in real-time. The processor circuit 405 then controls the driver 420 to move the moveable counterweight 220 to the new position. It will be understood that the driver 420 can be any system that can be used to move the moveable counterweight 220 along the track 205. For example, in some embodiments according to the invention, the driver 420 can include a rotating motor, a linear actuator, a piezoelectric actuator, or the like.

As described herein, customers may manipulate the position of an electronic point of sale terminal so that they may more efficiently interact with the terminal during checkout. However, if the point-of-sale terminal is positioned, for example, too far forward (or behind) of the terminal stand, the terminal may become unstable and fall over. Typically, compliance standards require that the terminal remain stable even if the display is positioned 15 degrees from the completely upright position. However, many times customers would like the terminal to be position beyond this compliance standard.

The terminology used herein is for the purpose of describing particular embodiments only and is not intended to be limiting to other embodiments. As used herein, the singular forms "a", "an" and "the" are intended to include the plural forms as well, unless the context clearly indicates otherwise. It will be further understood that the terms "comprises," "comprising," "includes" and/or "including", "have" and/or "having" when used herein, specify the presence of stated features, integers, steps, operations, elements, and/or components, but do not preclude the presence or addition of one or more other features, integers, steps, operations, elements, components, and/or groups thereof. Elements described as being "to" perform functions, acts and/or operations may be configured to or other structured to do so.

Unless otherwise defined, all terms (including technical and scientific terms) used herein have the same meaning as commonly understood by one of ordinary skill in the art to which various embodiments described herein belong. It will be further understood that terms used herein should be interpreted as having a meaning that is consistent with their meaning in the context of this specification and the relevant art and will not be interpreted in an idealized or overly formal sense unless expressly so defined herein.

While the foregoing is directed to aspects of the present disclosure, other and further embodiments of the disclosure may be devised without departing from the basic scope thereof, and the scope thereof is determined by the claims that follow.

What is claimed:

1. A stand for an electronic point-of-sale terminal, the stand comprising:

a moveable arm including a mounting plate at an upper end thereof and a moveable hinge at a lower end thereof, the moveable arm configured to move from a forward cantilevered position to a rearward cantilevered position over a check-out area associated with an electronic point-of-sale terminal;

the mounting plate configured to moveably couple the moveable arm to an electronic display of the electronic point-of-sale terminal;

the moveable hinge configured to rotate responsive to movement of the moveable arm;

a base plate configured to maintain the electronic point-of-sale terminal in an upright position when the electronic display is moved between the forward cantilevered position and the rearward cantilevered position; and a moveable counterweight inside the base plate, and moveably coupled to the moveable hinge, to move from a first counterweight position inside the base plate when the moveable arm is in the forward cantilevered position to a second counterweight position inside the base plate when the moveable arm is in the rearward cantilevered position.

2. The stand of claim 1 wherein the moveable arm and the moveable counterweight move in opposite directions when moving from the forward cantilevered position to the rearward cantilevered position.

3. The stand of claim 1 further comprising:

a linkage bar moveably coupling the moveable hinge to the moveable counterweight.

4. The stand of claim 3 wherein the linkage bar comprises a first linkage bar having an upper end coupled to the moveable hinge and a lower end opposite the upper end, the stand further comprising:

a second linkage bar having an upper end coupled to the lower end the first linkage bar and having a lower end coupled to the moveable counterweight inside the base plate.

5. The stand of claim 4 wherein the first linkage bar is coupled to the second linkage bar at a position that is offset from a point of rotation of the moveable hinge.

6. The stand of claim 3 further comprising:

an opening in the base plate through which the linkage bar extends.

7. The stand of claim 1 further comprising:

an electric motor coupled to the moveable counterweight;

a sensor circuit configured to indicate a position of the electronic display relative to the forward cantilevered position and the rearward cantilevered position;

a processor circuit operatively coupled to the sensor circuit and to the electric motor, the processor circuit configured to operate the electric motor to move the counterweight between the first counterweight position and the second counterweight position to counter balance a position of the electronic display between the forward cantilevered position and the rearward cantilevered position based on the position of the electronic display indicated by the sensor circuit.

8. The stand of claim 7 wherein the first and second counterweight positions are determined based on a weight of the electronic point-of-sale terminal, the cantilevered position of the electronic point-of-sale terminal, and a weight of the moveable counterweight.

9. A stand for an electronic point-of-sale terminal, the stand comprising:

a moveable arm including a mounting plate at an upper end thereof and a moveable hinge at a lower end thereof, the moveable arm configured to move from a forward cantilevered position to a rearward cantilevered position over a check-out area associated with an electronic point-of-sale terminal;

the moveable hinge coupled to a base plate of the stand and to the moveable arm, the moveable hinge configured to move responsive to movement of the moveable arm and;

a moveable counterweight inside the base plate; and an actuator means coupled to the moveable counterweight, the actuator means configured to move the moveable counterweight from a first counterweight position inside the base plate to a second counterweight position inside the base plate responsive to movement of the moveable arm from the rearward cantilevered position to the forward cantilevered position to keep the stand in contact with a surface.

10. The stand of claim 9 wherein the moveable arm and the moveable counterweight move in opposite directions when moving from the forward cantilevered position to the rearward cantilevered position.

11. The stand of claim 9 wherein the actuator means comprises a linkage bar moveably coupling the moveable hinge to the moveable counterweight.

12. The stand of claim 11 wherein the linkage bar comprises a first linkage bar having an upper end coupled to the moveable hinge and a lower end opposite the upper end, the actuator means further comprising:

a second linkage bar having an upper end coupled to the lower end the first linkage bar and having a lower end coupled to the moveable counterweight inside the base plate.

13. The stand of claim 9 wherein the actuator means comprises:

an electric motor coupled to the moveable counterweight;

a sensor circuit configured to indicate a position of an electronic display coupled to the moveable arm relative to the forward cantilevered position and the rearward cantilevered position;

a processor circuit operatively coupled to the sensor circuit and to the electric motor, the processor circuit configured to operate the electric motor to move the counterweight between the first counterweight position and the second counterweight position to counterbalance a position of the electronic display between the forward cantilevered position and the rearward cantilevered position based on the position of the electronic display indicated by the sensor circuit.

14. The stand of claim 13 wherein the first and second counterweight positions are determined based on a weight of the electronic display, the position of the electronic display, and a weight of the moveable counterweight.

15. The stand of claim 9 wherein the actuator means comprises:

a linear actuator coupled to the moveable counterweight;

a sensor circuit configured to indicate a position of an electronic display coupled to the moveable arm relative to the forward cantilevered position and the rearward cantilevered position;

a processor circuit operatively coupled to the sensor circuit and to the linear actuator, the processor circuit configured to operate the linear actuator to move the counterweight between the first counterweight position and the second counterweight position to counterbalance a position of the electronic display between the forward cantilevered position and the rearward cantilevered position based on the position of the electronic display indicated by the sensor circuit.

16. The stand of claim 15 wherein the linear actuator comprises:

a mechanical actuator, a pneumatic actuator, and/or a piezoelectric actuator.

* * * * *